United States Patent [19]

Yates

[11] 4,117,610

[45] Oct. 3, 1978

[54] COMBINATION BULLDOZER BLADE AND BUCKET ASSEMBLY FOR EARTH WORKING EQUIPMENT

[76] Inventor: George A. Yates, 111 Woodlawn Ave., Grove City, Ohio 43123

[21] Appl. No.: 845,823

[22] Filed: Oct. 26, 1977

Related U.S. Application Data

[63] Continuation of Ser. No. 713,640, Aug. 12, 1976, abandoned.

[51] Int. Cl.[2] ..... E02F 3/76

[52] U.S. Cl. ..... 37/117.5; 214/146 E; 214/145 R

[58] Field of Search ..... 37/117.5, 103, 118 A, 37/DIG. 3; 214/147, 145 R, 145 A, 138 R, 130, 131 R, 767, 146 R, 146.5, 146 E, 131 A

[56] References Cited

U.S. PATENT DOCUMENTS

| | | | |
|---|---|---|---|
| 2,864,518 | 12/1958 | Beyerstedt | 214/146 E |
| 3,043,032 | 7/1962 | Discenza | 37/117.5 |
| 3,115,261 | 12/1963 | Antolini | 37/117.5 X |
| 3,312,361 | 4/1967 | Foster | 214/145 |
| 3,362,554 | 1/1968 | Fortier | 37/117.5 X |
| 3,419,170 | 12/1968 | Salna et al. | 37/117.5 X |
| 3,440,744 | 4/1969 | Smith | 37/117.5 |
| 3,458,069 | 7/1969 | Wickberg et al. | 37/117.5 X |
| 3,706,388 | 12/1972 | Westendorf | 214/145 |
| 3,845,870 | 11/1974 | Balderson | 214/145 |
| 3,921,316 | 11/1975 | Moreau | 37/117.5 X |

FOREIGN PATENT DOCUMENTS

| | | | |
|---|---|---|---|
| 1,814,391 | 7/1969 | Fed. Rep. of Germany | 37/103 |
| 2,153,745 | 2/1973 | Fed. Rep. of Germany | 37/DIG. 3 |
| 2,459,489 | 7/1974 | Fed. Rep. of Germany | 37/DIG. 3 |

*Primary Examiner*—E. H. Eickholt

*Attorney, Agent, or Firm*—Stanley J. Price, Jr.; John M. Adams

[57] ABSTRACT

A combination bulldozer blade and materials handling bucket is mounted on the front end of an earth working machine. The bulldozer blade portion of the combination device is generally constructed and arranged to function in a substantially conventional manner. Pivotally mounted about the bulldozer blade and suitably provided with powered actuation means is a scoop having a concave bottom and parallel sides. Powered actuation of the scoop to a retracted position between the blade and the machine sets up the machine in its bulldozing mode. Having used the machine to bulldoze a pile of material into contact with the blade, the scoop is then actuated to its extended position, through the pile of material, thereby depositing the material encompassed by the scoop into an upwardly open bucket formed between the blade and the bottom and sides of the scoop. The material in the bucket is then moved by the machine to a suitable site and deposited by powered retraction of the scoop, whereby the blade functions as an ejector plate. Also, optionally attached to the blade is at least one lug for attachment of a fork to provide forklift capability or attachment of a chain or the like, to provide general haulage capability.

8 Claims, 7 Drawing Figures

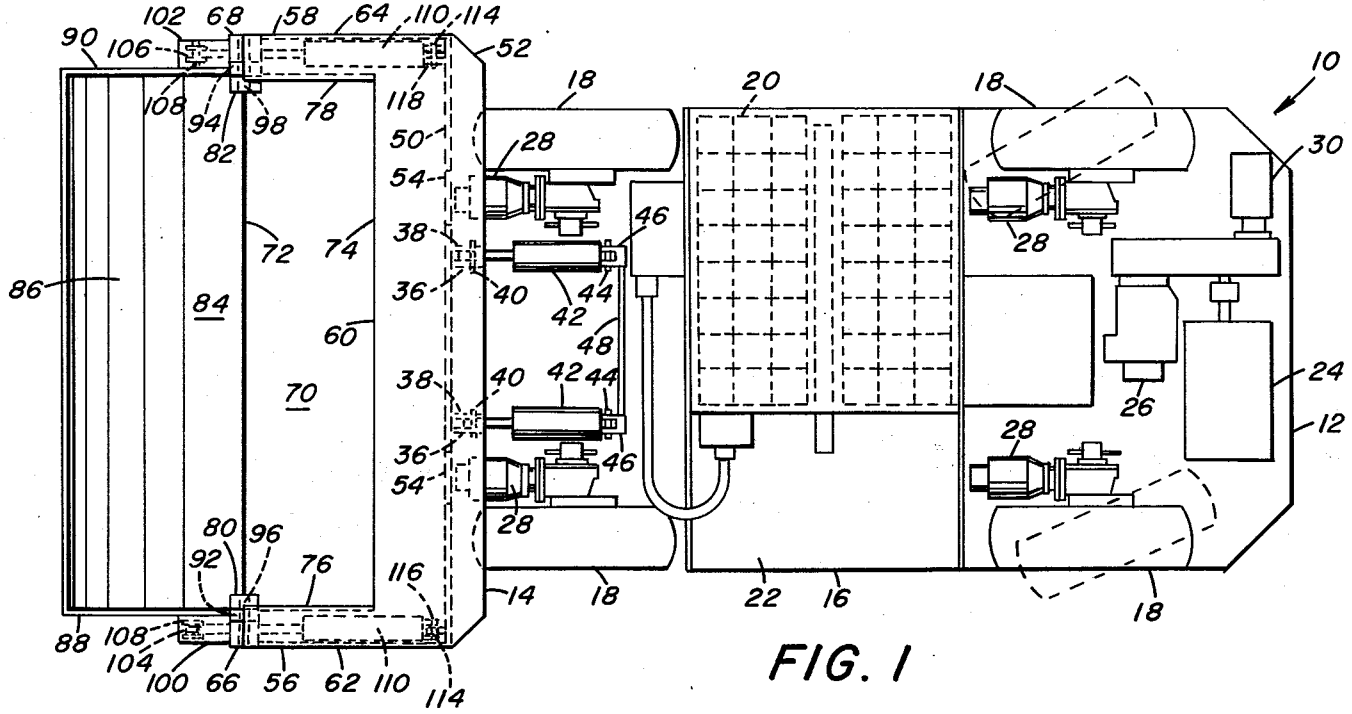
FIG. 1
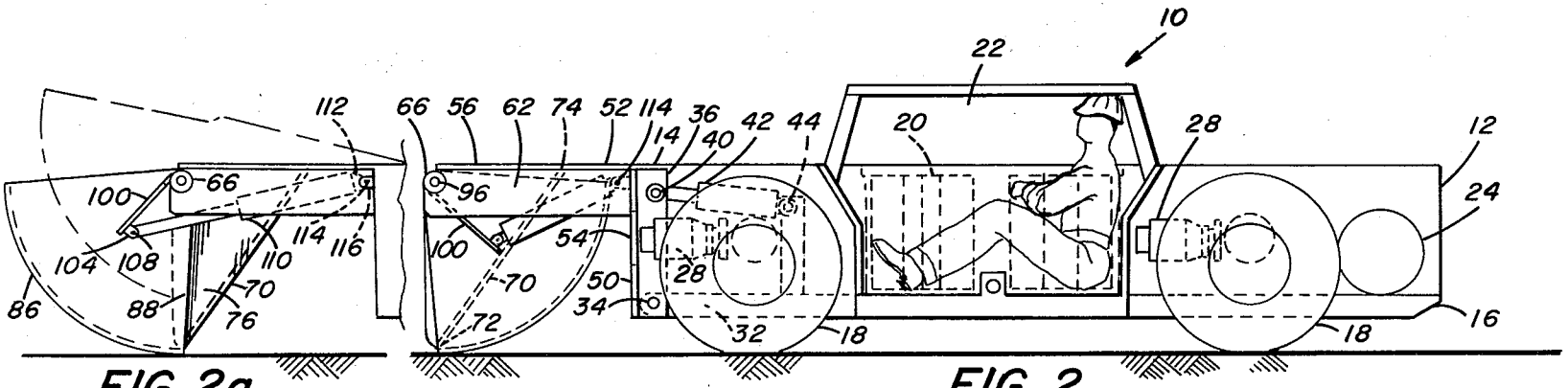
FIG. 2
FIG. 2a

COMBINATION BULLDOZER BLADE AND BUCKET ASSEMBLY FOR EARTH WORKING EQUIPMENT

CROSS REFERENCE TO RELATED APPLICATION

This application is a continuation of co-pending application Ser. No. 713,640 filed on Aug. 12, 1976, entitled "Combination Bulldozer Blade And Bucket Assembly For Earth Working Machine" now abandoned.

BACKGROUND OF THE INVENTION

1. Field of the Invention

This invention relates to materials handling apparatus and, more specifically, to a combination bulldozer blade and materials handling bucket having ejector capability for earth moving operations and which may also be optionally provided with forklift capability and other general haulage capability.

2. Description of the Prior Art

A number of skid shovel and scoop shovel machines are manufactured or disclosed in patents for earth moving operations both underground, as in mining or tunneling, or above ground, as in strip mining or other earth stripping operations. Frequently, such machines are specifically designed to provide a multiplicity or other useful functions, such as bulldozing, scraper operations, clamshell operations and, on occasion, general demolition functions. Typical such machines are disclosed in U.S. Pat. Nos.

| | | |
|---|---|---|
| 2,812,595 | 2,924,345 | 3,077,999 |
| 3,148,787 | 3,250,128 | 3,252,606 |
| 3,296,720 | 3,334,430 | 3,346,974 |
| 3,477,602 | 3,542,223 | 3,842,999 |
| 3,921,316 | | |

Generally, skid shovel and scoop shovel machines per se, function adequately as earth transportation machines, so long as another machine, such as a bulldozer, is available to excavate or initially remove and pile up the material to be transported thereby. However, by reason of the very nature of the basic design of skid shovel and scoop shovel machines, they do not function efficiently to initially excavate the material to be transported and, accordingly, their transportation efficiency is seriously diminished. Moreover, in certain environments, such as underground mining operations, where available working height is limited, the design mode of operation of these machines add additional limitations, particularly when they are outfitted with additional equipment provided to render the machine multifunctional, such as providing one or more of the additional functions mentioned above.

Keeping in mind that, for a multitude of earth moving operations, the principal functions of earth removal or excavation combined with earth collection and transportation, at a maximum potential capacity in a minimum amount of time, are of paramount interest, no known skid shovel or scoop shovel machine performs fully to these desiderata. In particular, the bulldozing of loose earth material into a pile cannot generally be efficiently done by the buckets of skid shovel and scoop shovel machines. The loose material tends to roll along and then slip under the bucket's leading edge. Moreover, in order to get the earth material into the bucket without assistance from other machines, the operators tram the machines at maximum, attempting to force the material rearwardly the full length or extent of the bucket bottom. However, only partial loads are possible by this operation considering the full available volume of the bucket. Of course, the shock loads on the vehicle are very destructive of the entire vehicle structure. Furthermore, if the skid or scoop bucket is used as a primary haulage unit, its productivity is extremely limited due to the small loads being transported. Accordingly, there is a need for improvements in earth moving machines of the type discussed so as to provide for earth removal or excavation combined with earth collection and transportation, at maximum potential capacity in a minimum amount of time, in order to greatly enhance productivity and machine utilization.

SUMMARY OF THE INVENTION

In accordance with the present invention, an improved combination of a bulldozer blade and a materials handling bucket is mounted on the front end of an earth working machine. Basically, the improved combination comprises a bulldozer blade, a scoop with bottom and side walls adapted to be pivotally mounted by the side walls so as to be movable through an arcuate path about the blade and powered means to move the scoop through said arcuate path.

More specifically, the bulldozer blade of this invention is mounted on the earth working machine in a relatively conventional, substantially vertical disposition by means of a rigid support arrangement extending from the blade to the machine. The support arrangement is provided with the ability to lower the blade into ground contact during bulldozing and to elevate the blade a sufficient amount to obtain clearance of the bottom edge of the blade above the adjacent ground line between bulldozing operations or during movement of the machine from one location to another. The bucket portion of the disclosed combination device is formed by the blade functioning in cooperation with a scoop arranged to rotate about the blade. The scoop has a concave bottom and parallel side walls and the side walls are pivotally mounted at their upper ends such that the bottom can move through an arcuate path about the lower edge of the bulldozer blade.

When the scoop is moved by connected power means to its position between the blade and the machine, the bulldozing mode is established. After bulldozing a pile of material to be moved and while the bulldozer blade is in contact with the pile of material to the full height of the blade the scoop is moved through its arcuate path and through the pile of material to its extended or forward position.

As the scoop moves through the pile of material, the material encompassed by the widthwise dimension of the scoop is collected in the gradually enlarging, upwardly open bucket formed between the bulldozer blade and the bottom and sides of the scoop. Upon the scoop reaching its fully extended position, the so-formed bucket is filled to its capacity. The material collected in the bucket is then moved by the earth working vehicle to a desired site and deposited there by powered retraction of the scoop. During such powered retraction, the bulldozer blade functions as an ejector plate to completely empty the bucket upon full retraction of the scoop. The earth working vehicle is then ready for additional doze-lift-haul-dump operations. Also, optionally attached to the bulldozer blade is at least one lug for attachment of a fork to provide forklift capability or attachment of a chain, cable, or the like, to provide general haulage capability.

BRIEF DESCRIPTION OF THE DRAWINGS

In the drawings, wherein like numerals are used to indicate like parts throughout the same:

FIG. 1 is a schematic top plan of a front end loader of this invention showing the scoop portion of the combination bulldozer blade and materials handling bucket in its forward or extended position for hauling or tramming with a loaded bucket;

FIG. 2 is a schematic, side elevation of the loader of FIG. 1 showing the scoop portion of the combination bulldozer blade and materials handling bucket in its retracted position aft of the blade to establish the bulldozing mode of operation;

FIG. 2*a* is a schematic fragmentary, side elevation of the forward end portion of the loader of FIG. 1 showing, in solid and dotted line, further details of the combination bulldozer blade and materials handling bucket when its scoop portion is in its forward or extended position, and, in addition, illustrating in phantom an elevated position of the bucket for hauling or tramming with the bucket loaded;

DESCRIPTION OF PREFERRED EMBODIMENTS

Figure 6:
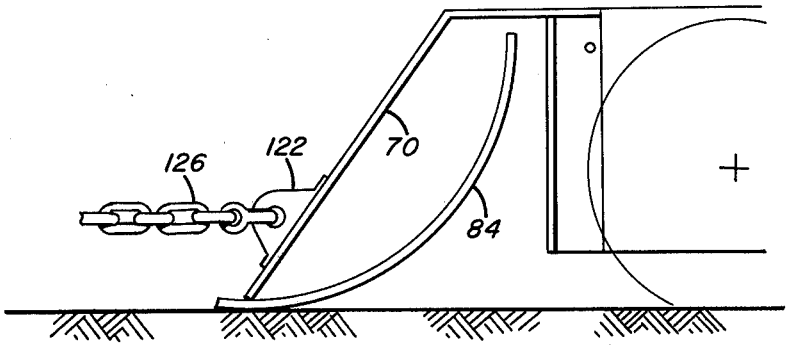
FIG. 6 is a view similar to FIG. 5 illustrating a chain attached according to this invention for general haulage or towing operations.

Referring to the drawings and, in particular, to FIGS. 1, 2 and 2*a*, there is illustrated an earth working machine of the front end loader type generally designated by the numeral 10. The machine 10 is comprised essentially of a transport unit 12 and an earth working unit 14. Transport unit 12 may be any conventional tractor unit, crawler unit or other translatable frame unit.

A preferred transport unit 12, shown in FIGS. 1 and 2, is comprised of a chassis or frame 16 and wheels 18 and is powered by a bank of batteries 20. The batteries 20 are preferably located, as shown, between the front and rear wheels 18 adjacent the operator's compartment 22. Batteries 20 supply electric power to motor 24 which, in turn, drives a hydraulic pump 26 to supply fluid energy to the hydraulic motors 28 that provide independent tractive power to each wheel 18. A second pump 30 is also driven by motor 24 to supply pressurized hydraulic fluid for operation of the various hydraulic jacks or piston cylinder assemblies used in operating the earth working unit 14.

As aforesaid, the earth working unit 14 of this invention includes a combination bulldozer blade and materials handling bucket that is pivotally mounted to the front end of frame 16. The frame front end includes a pair of forwardly extending arms 32 (one of which is illustrated in FIG. 2) each having a lugged end portion 34 with a bore therethrough. Pivotally mounted to the arms 32 in a manner explained later in greater detail, at spaced locations on the earth working unit 14 are pairs of upstanding tilt bars 36 and 38 positioned thereon. Each tilt bar 36 and 38 of a pair of tilt bars is provided at its upper end portion with an aperture (not shown) such that all of said tilt bar apertures are in horizontal alignment. Pivotally affixed to each pair of tilt bars 36 and 38, at their respective pairs of apertures by a pin 40, is the piston rod end of one of a pair of tilt piston cylinder assemblies 42. The cylinder portion of each assembly 42, in turn, has a lug that is pivotally attached by a pin 44 to one of a pair of upstanding clevis bars 46 rigidly mounted on the front end of frame 16 in lateral, rearward alignment with a respective one of said tilt bar pairs. Pins 44 extend through horizontally aligned apertures (not shown) in clevis bars 46 at a lower elevation than the elevation of pins 40, such that, upon actuation of piston cylinder assemblies 42, pivotal movement of the pairs of tilt bars 36 and 38 about end portions 34 is established. Also shown interconnecting clevis bars 46 is a tie plate or tie bar 48 that extends upwardly from frame 16 to add additional strength and rigidity to the clevis bar assembly.

Rigidly affixed, as by welding, to the forward edges of the pairs of tilt bars 36 and 38, is a yoke support plate 50 of the earth working unit 14. Yoke support plate 50 extends the full height of the tilt bars, and a yoke plate 52 is rigidly secured, as by welding, at a substantially right angle to the upper edge of yoke support plate 50. The yoke plate 52 is secured at the rearward portion thereof on the upper edges of tilt bars 36 and 38. As shown, yoke support plate 50 is provided with apertures 54 to permit passage therethrough of an adjacent portion of the front wheel hydraulic drive motors 28 during rearward pivotal movement of tilt bars 36 and 38.

Yoke plate 52 is essentially a U-shaped plate that includes spaced parallel, forwardly extending arm portions 56 and 58 and an integral, interconnecting rear web portion 60 that is rigidly secured to support plate 50 and tilt bars 36 and 38. Reinforcing the arm portions 56 and 58 of yoke plate 52 are yoke side plates 62 and 64. Yoke side plates 62 and 64 are rigidly secured, as by welding, along substantially the entire outer marginal edge portion of the bottom surface of each arm 56 and 58, across the adjacent, bottom marginal edge portions of web 60 and to the upper, widthwise marginal edge portions of support plate 50. As illustrated laterally aligned cylindrical bosses 66 and 68 are rigidly affixed, as by welding, to the upper, free end portion of a respective side plate 62 and 64 and, preferably, also to the adjacent bottom surface of the respective arms 56 and 58. For reasons that will become apparent hereinafter, the cylindrical bosses 66 and 68 do not extend the full width of arms 56 and 58.

In the embodiment shown, bulldozer blade 70 is preferably a forwardly inclined blade, i.e., its bottom or cutting edge 72 is disposed forwardly of its upper or rear edge 74. As will be understood, this forwardly inclined arrangement will, among other things, increase the materials handling capacity of the bucket that ultimately will be formed therewith. Moreover, in the arrangement shown, the cutting edge 72 is preferably disposed in substantially vertical alignment below coaxially aligned cylindrical bosses 66 and 68 and its rear edge 74 is affixed, as by welding, to the inner edge of web 60 between arms 56 and 58. Accordingly, a pair of spaced, parallel, inverted substantially right triangular, blade side plates 76 and 78 are provided and are welded, or otherwise affixed, to the transverse opposite side edge portions of bulldozer blade 70 and to inner edge portions of arms 56 and 58. Preferably, as shown, side plates 76 and 78 extend forwardly of cutting edge 72 for a short distance. Rigidly affixed in the upper, forward or right angular corner of blade side plates 76 and 78, as by welding, are laterally aligned cylindrical bosses 80 and 82. Cylindrical bosses 80 and 82, as shown, extend from side plates 76 and 78 in a direction toward each other and are also laterally aligned or coaxially aligned with the cylindrical bosses 66 and 68 of yoke side plates 62 and 64.

The scoop 84, of this invention, is comprised of a cylindrical, concave bottom plate 86, as viewed from front to rear edge, having a pair of laterally spaced, parallel, pie-shaped side plates 88 and 90 welded or otherwise affixed to its side edges. As viewed from the side, scoop 84 forms essentially one-fourth of a closed cylinder. Rigidly secured to each scoop side plate 88 and 90, at the center of revolution of cylindrical bottom plate 86, is one of a pair of cylindrical bosses 92 and 94. The scoop bosses 94 and 92 are preferably welded to side plates 88 and 90 and, as shown, extend therefrom in a direction laterally away from each other. Also, as shown, when scoop 84 is in its installed position, cylindrical bosses 92 and 94 interfit between and are coaxially aligned with cylindrical bosses 66, 68, 80 and 82, such that pins 96 and 98 secure scoop 84 for pivotal or rotational movement about bulldozer blade 70.

Bracket plates 100 and 102 are shown affixed, as by welding, to the outer major surfaces of scoop side plates 88 and 90, respectively, and are suitably provided with clevis attachments, 104 and 106 at their lower ends. Pivotally attached to clevis attachments 104 and 106, as by pins 108, is the piston rod end of one of a pair of piston cylinder assemblies 110. The cylinder portion of each assembly 110, in turn, has a lug 112 that is pivotally attached by a pin 114 to one of a pair of clevis attachments 116 and 118 affixed to yoke support plate 50 in lateral and rearward alignment with clevis attachments 104 and 106. Clevis attachments 116 and 118 are at a higher elevation than clevis attachments 104 and 106 such that, upon actuation of piston cylinder assemblies 110, pivotal or rotational movement of scoop 84 from its fully extended position through an arc of approximately 90° is readily accomplished.

Preferably, as shown, bracket plates 100 and 102 extend upwardly to or approximately to cylindrical bosses 92 and 94 and are of a width sufficient to protect piston cylinder assemblies 110 from damage by, for example, material overflowing scoop 84. Also, it will be noted in FIG. 2*a*, that blade side plates 76 and 78 slightly overlap scoop side plates 88 and 90 when scoop 84 is in its extended or forward position. This arrangement, among other things, precludes the possibility of a sufficiently large object lodging between the respective side plate edges to jam the operation of the piston cylinder assemblies 110.

Figure 3:
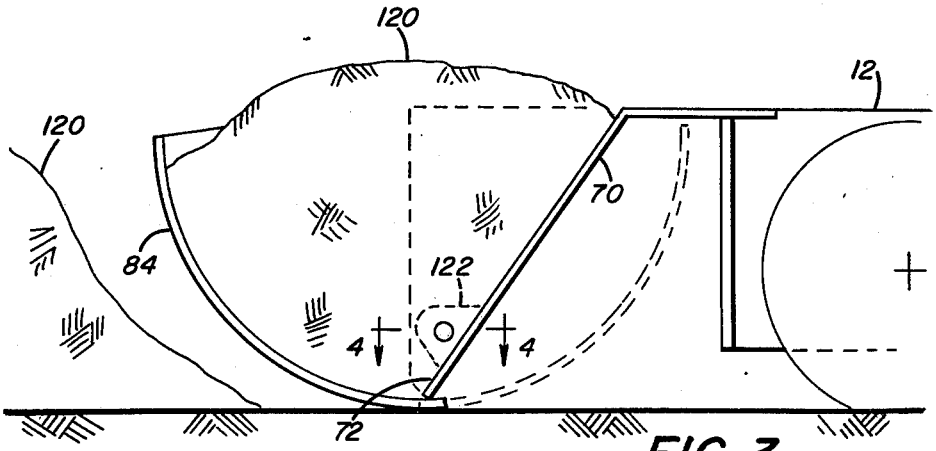
FIG. 3 is an enlarged, fragmentary, schematic, side elevation, similar to FIG. 2*a*, illustrating a loaded bucket and, in phantom, the scoop positioned for bulldozing operations.

Referring specifically to FIG. 3, the mode of operation of the apparatus of this invention will become more apparent. As therein illustrated, material 120, such as earth material, has been bulldozed into a pile by bulldozer blade 70 while scoop 84 was held in its retracted position (shown in phantom) with its leading edge disposed directly below cutting edge 72 of bulldozer blade 70. Preferably, for maximum efficiency, material 120 was bulldozed to the full height of bulldozer blade 70. While material 120 stands, as aforesaid, preferably to the full height of bulldozer blade 70, powered actuation of piston cylinder assemblies 110 rotates scoop 84 through its arcuate path of movement about bulldozer blade 70, such that the scoop 84 moves upwardly, through the material 120, to completely fill a bucket formed between scoop 84 and bulldozer blade 70. As shown in FIG. 3, the so-formed bucket full of material 120 may then be backed away from the standing pile by transport unit 12 and, thereafter, elevated, as aforesaid, for transport to a suitable discharge site, or alternatively, elevation may precede movement of transport unit 12 away from the pile of material 120. Regardless of the specific sequence, filling of the bucket according to this invention is accomplished by moving scoop 84 upwardly through the material 120 to provide a progressively enlarging, upwardly open bucket between scoop 84 and bulldozer blade 70.

Figure 4:
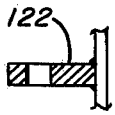
FIG. 4 is a fragmentary sectional view, taken along the line 4—4 of FIG. 3, illustrating a lug secured to the bulldozer blade or bucket back plate for connection of a forklift unit or attachment of a towing chain, cable or the like, FIG. 5 is a view similar to FIG. 3 with the scoop retracted, illustrating the attachment of a forklift unit according to this invention and, in phantom, the forklift unit in a raised position for tramming.

FIG. 3 further shows an apertured lug 122 that is affixed, as by welding, to a lower portion of bulldozer blade 70 and FIG. 4 shows a sectional view of lug 122. As disclosed above, one or more of such upstanding lugs 122 may desirably be affixed to a lower portion of bulldozer blade 70 for the purpose of attaching thereto a forklift unit, a chain, a cable or like haulage devices.

Figure 5:
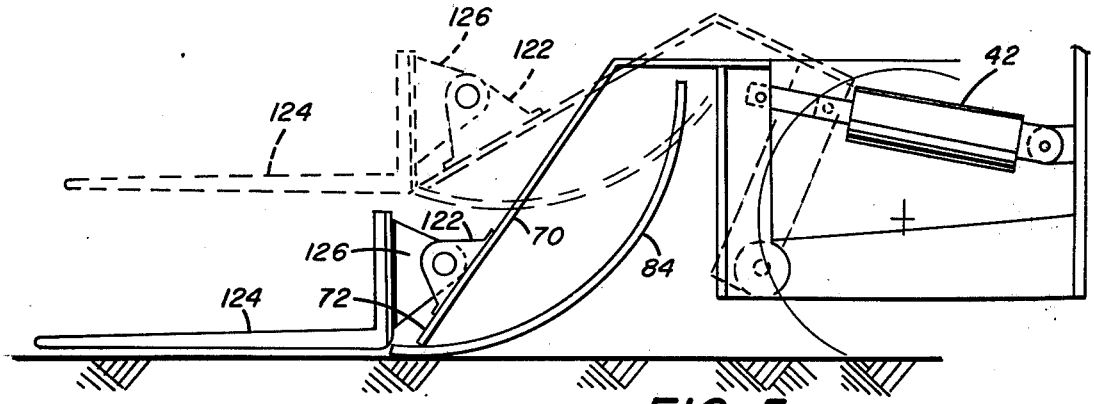

As shown in FIG. 5, one such option is a forklift unit 124. While only one lug 122 is shown, it will be understood that additional laterally aligned or suitably located lugs may be provided, as required. Also shown on forklift unit 124 is a companion lug 126, which may comprise one of several such lugs, for pivotal attachment of forklift unit 124 to bulldozer blade 70, as by pins or the like (not shown). It being understood that many mechanical equivalents to the simple lug pinned to lug structure illustrated will occur to those skilled in the art, it is, however, desirable that the means of attachment used will permit pivoting of forklift unit 124 with respect to bulldozer blade 70. The reason for desiring a pivotal attachment is that it is often useful to be able to position or maintain the forwardly extending forks of forklift unit 124 in a horizontal plane, as well as in a slight upward inclination to the horizontal. In accordance with the invention, this is accomplished by providing a pivotal interconnection between the forklift unit 124 and bulldozer blade 70, such that the forward edge of scoop 84 may be extended forwardly of the cutting edge 72 of bulldozer blade 70 to support forklift unit 124 in a horizontal position at ground level and, thereafter, gradually retracted by piston cylinder assemblies 110, upon elevation of bulldozer blade 70 by the tilt piston cylinder assemblies 42, so that the forks of unit 124 may continuously be maintained in a horizontal position throughout the full tilt range available.

As shown in FIG. 6, one or more lugs 124 may also be usefully employed for attachment of a towing chain 126 or a towing cable or the like, for general haulage purposes. Such general haulage uses include moving skid mounted power centers, moving disabled machinery and earth working equipment and, in general, moving materials and supplies.

It should be apparent that many mechanical equivalents of the hereinabove disclosed apparatus will occur to those skilled in the art. For example, the bulldozer blade may, if desired, be vertically disposed at a right angle to the ground and/or it may also be arcuately formed from its top to its bottom edges. Also, cutting teeth and/or cutting blades or the like may be affixed to the leading or cutting edges of the scoop or the bulldozer blade or both. Accordingly, it should be understood that, within the scope of the appended claims, this invention may be practiced otherwise than as specifically illustrated and described.

I claim:

1. A combination bulldozer blade and scoop assembly for earth working equipment comprising, support means to support a bulldozer blade and a scoop in operative position for bulldozing with a bulldozer blade and for transporting material in a scoop, a bulldozer blade fixedly secured to said support means and having an upper edge portion and a lower edge portion, a scoop having a bottom portion and a pair of parallel side portions connected to said bottom portion, said scoop bottom portion having an arcuate semicylindrical configuration, each of said scoop side portions having an edge portion, pivot means pivotally connecting each of said scoop side portions to said support means to thereby pivotally connect said scoop to said support means with said bulldozer blade positioned within said scoop bottom portion, each of said scoop parallel side portions having a bracket plate secured thereto and depending downwardly below said pivot means, said scoop arranged to move through a circular path around said bulldozer blade so that in a first retracted position of said scoop said bulldozer blade is in an operative position for bulldozing and, in a second advanced position of said scoop said bulldozer blade provides the back wall of an upwardly open bucket, and piston cylinder assemblies connected at one end to said support means and at the other end to said bracket plates secured to said scoop side portions at a location below said pivot means and said support means, one end of said piston cylinder assemblies connected to said support means at an elevation above the connection of said other end so that upon extension of said piston cylinder assemblies said scoop pivots about said pivot means and moves around said bulldozer blade lower edge portion in a circular path from a retracted position to an extended position while said scoop remains at an elevation below said support means.

2. The combination according to claim 1 wherein said bulldozer blade is inclined forwardly from said upper portion to said lower edge portion.

3. The combination according to claim 2, wherein said bulldozer blade includes spaced, parallel side portions connected to said forwardly inclined bulldozer blade.

4. The combination according to claim 3 wherein said scoop side portions and said bulldozer blade side portions are constructed and arranged so that said scoop side portions overlap said bulldozer side portions when said scoop is in its forward position.

5. The combination according to claim 1, further including tilt means operatively associated with said support means to pivot said support means about a horizontal axis.

6. The combination according to claim 1, further including at least one attachment lug affixed to the bulldozing surface of said bulldozer blade.

7. The combination according to claim 6 which includes a forklift unit attached to said attachment lug, said forklift unit having a lower portion arranged to contact the leading edge of said scoop when said scoop leading edge is moved forwardly of the cutting edge of said bulldozer blade.

8. The combination according to claim 7 wherein said lug is positioned on a lower portion of the bulldozing surface of said bulldozer blade.

* * * * *